United States Patent [19]

Jorgensen

[11] 3,941,301

[45] Mar. 2, 1976

[54] STACKABLE PACKAGING CONTAINER

[75] Inventor: Arne Jorgensen, Korsor, Denmark

[73] Assignee: Lever Brothers Company, New York, N.Y.

[22] Filed: Apr. 22, 1974

[21] Appl. No.: 463,020

[52] U.S. Cl. ..... 229/14 BE; 206/518; 220/74

[51] Int. Cl.[2] ..... B65D 5/62

[58] Field of Search ..... 229/14 BE, 32, 3.5 MF; 206/515, 518, 519, 520; 220/74; 40/312

[56] References Cited

UNITED STATES PATENTS

| | | | |
|---|---|---|---|
| 1,892,756 | 1/1933 | Van Horne | 229/43 |
| 3,077,284 | 2/1963 | McLaughlin | 206/519 X |
| 3,233,812 | 2/1966 | Kennedy | 206/518 X |
| 3,268,144 | 8/1966 | Gaunt | 220/74 X |
| 3,344,974 | 10/1967 | Bostrom | 206/518 X |
| 3,392,874 | 7/1968 | Peebles | 206/518 X |
| 3,423,004 | 1/1969 | Christensson | 229/14 BE |
| 3,721,367 | 3/1973 | Fletcher | 206/519 |
| 3,785,544 | 1/1974 | Smith | 229/14 BE |

*Primary Examiner*—Davis T. Moorhead

*Attorney, Agent, or Firm*—Lever Brothers Company

[57] ABSTRACT

A stackable packaging container having an open top and a body portion tapering inwardly from the top to the bottom has a rim formed by an outwardly extending peripheral flange and a downwardly dependent flange depending from the outward flange to be spaced from the body portion. De-nesting recesses are formed in the downwardly dependent flange of the rim to prevent the containers jamming inside one another when stacked, the recesses not interrupting the smooth inner wall of the body portion.

4 Claims, 4 Drawing Figures

STACKABLE PACKAGING CONTAINER

The invention relates to a stackable packaging container and particularly to a stackable packaging container having a top, a base panel and a body portion inwardly tapering from the top to the base panel.

Because the body portion, formed by a side wall or walls, tapers towards the base it is possible, with a view to saving space, to stack the empty packaging containers in each other telescopically during storage. When this is done, however, there is a chance that the packaging containers will jam in each other, so causing trouble during the automatic dispensing one by one of the packaging containers, in which each time the weight of the undermost packaging container causes its release from the stack.

In order to prevent the above-mentioned jamming in each other of stacked packaging containers of the kind at issue, it has already been proposed to provide, near the base of the packaging container, inwardly projecting recesses in the side wall or side walls so that when the containers are stacked in each other the base of a packaging container lying above rests on shoulders formed by the recesses in the wall of the packaging container lying below it. It has also been proposed to provide, near the open upper end of the packaging container, outwardly extending projections in its side wall or side walls, so that when the containers are stacked in each other the projection of a packaging container come to rest on the upper rim of the packaging container lying below it.

All these known measures for avoiding jamming of packaging containers telescopically stacked in each other have the drawback that the inside wall of the container is no longer smooth at the position of the recesses or projections. This can hamper complete emptying of a filled packaging container, particularly if this is intended for packaging highly viscous or pasty products, e.g., margarine.

According to the present invention there is provided a stackable packaging container having an open top, a base panel, a body portion inwardly tapering from the open top to the base panel, and a rim at the open top comprising an outwardly extending peripheral flange and a downwardly depending flange outwardly spaced from the body portion of the container, a plurality of recesses in the downwardly depending flange extending inwardly towards the body portion. When such packaging containers are telescopically stacked in each other, a packaging container lying above comes to rest with the recesses provided in the downwardly extending flange in engagement with the peripheral flange of the packaging container lying below it.

Preferably the recesses have lowermost edges which form shoulders in the plane of the lower edge of the downwardly depending flange thereby ensuring that there is no overlapping of the downwardly depending flanges of adjacent containers in a stack.

A flange can be provided extending outwardly from the lower edge of the downwardly depending flange to stiffen the downwardly depending flange.

The packaging container can have a body portion which in horizontal section, is polygonal with rounded corners, the recesses in the downward dependent flange being provided at the rounded corners.

In a preferred embodiment of the packaging container according to the invention an external container is folded from a blank of cardboard or similar material to form the body portion and the base panel with an inner protective liner inside which is at least locally attached to the inside of the external container, the protective liner extending outwardly of the external container to form the rim.

According to another aspect of the invention there is provided a method for the manufacture of a packaging container having an external container folded from a blank of cardboard or similar material to form the body portion and the base panel, and an inner protective liner inside and attached at least locally to the inside of the external container, the protective liner extending outwardly of the container to form the rim, in which the inner liner is of thermoplastic material deep drawn into the external container, the rim and recesses being formed when the thermoplastic material has been heated to the temperature required for deep drawing.

The invention will now be further described with reference to the accompanying diagrammatic drawings showing a preferred embodiment of the packaging container according to the invention in which.

Figure 1:
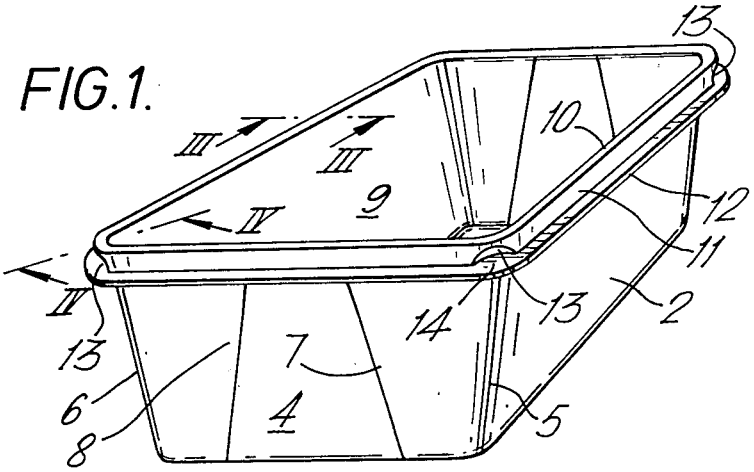
FIG. 1 is a perspective view of the packaging container.
Figure 2:
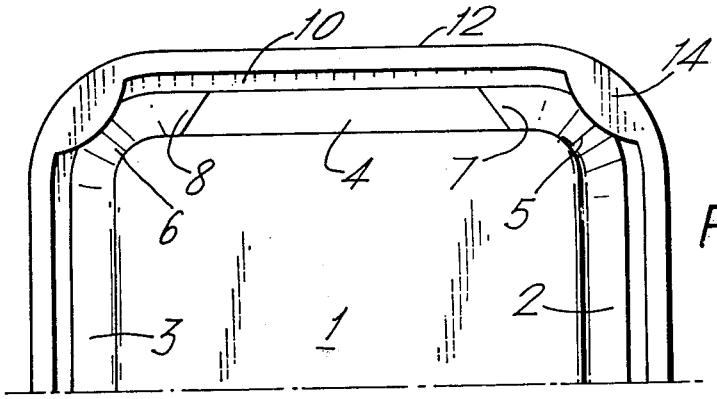
FIG. 2 shows, on a larger scale, a plan view from below of a part of the packaging container shown in FIG. 1.
Figure 3:
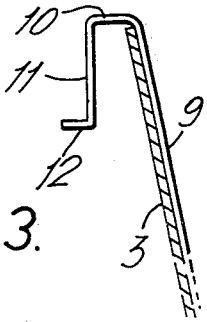
FIG. 3 shows, on a larger scale, a vertical section along the line III—III of FIG. 1.
Figure 4:
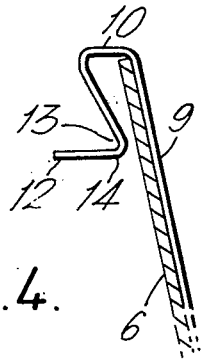
FIG. 4 is a view similar to FIG. 3 showing a vertical section along the line IV—IV of FIG. 1.

The packaging container shown consists of an external cardboard container open at its top and in which a protective liner has been applied by means of deep drawing, the protective liner extending outwardly of the external container to form a rim.

The external cardboard container forming the body portion and base panel of the packaging container has been erected from a blank with a base panel 1 with which the side walls 2 and 3 are connected along folding lines. Each of the end walls is formed by a panel 4 connected with the base panel along a folding line, the panels 4 having been glued to extensions 7 and 8 of the side walls 2 and 3 to form rounded corners to the body portion. In the container formed in this manner the liner 9 has been applied by deep-drawing, the liner surrounding the free upper rim of the external cardboard container 1–8. The liner 9 has an outwardly extending continuous peripheral flange 10 which is extended to form a downwardly depending flange 11 spaced from the body portion of the container. Outwardly extending from the lower edge of flange 11 is a further flange 12.

At the position of the rounded corners recesses 13 are formed in the downwardly depending flange 11, the lowermost edges 14 of the recesses coinciding with the plane of the outwardly extending flange 12. Thus the recesses 13 form denesting bosses the edges 14 of which come to rest, when the packaging container shown is telescopically stacked with a like container, on the peripheral flange 10 of the packaging container lying below it and so prevent the packaging containers from jamming in each other.

The recesses 13 of the downwardly depending flange 11 are made therein when the plastic material for forming the liner 9 has the temperature required for deep-drawing. It is clear that the invention is not restricted to the container shown in the figures but can also be used for a container consisting entirely of plastic material or of paper pulp.

What is claimed is:

1. A stackable packaging container comprising an external container folded from a blank of cardboard material, the external container having a base panel and a body portion having an open top, the body portion inwardly tapering from the open top to the base panel, and an inner protective liner in close contact with the container and attached at least locally to the container, the liner extending outwardly and downwardly of the open top to form a rim having a downwardly depending flange outwardly spaced from the body portion of the container, a plurality of de-nesting recesses in the downwardly depending flange extending inwardly towards the body portion, said de-nesting recesses being spaced along said downwardly depending flange.

2. A container according to claim 2 in which the recesses have lowermost edges lying in the plane of the lower edge of the downwardly depending flange.

3. A container according to claim 2 comprising a flange extending outwardly from the lower edge of the downwardly depending flange.

4. A container according to claim 3 in which the body portion in horizontal section is polygonal with rounded corners, the recesses in the downwardly depending flange being provided at the rounded corners.

* * * * *

UNITED STATES PATENT OFFICE

CERTIFICATE OF CORRECTION

Patent No. 3,941,301 Dated March 2, 1976

Inventor(s) Arne Jorgensen

It is certified that error appears in the above-identified patent and that said Letters Patent are hereby corrected as shown below:

Title page, under line entitled [21] Appl. No.:, insert --[30] Foreign Application Priority Data April 24, 1973 The Netherlands . . . 7,305,660

Signed and Sealed this

Twenty-first Day of September 1976

[SEAL]

*Attest:*

RUTH C. MASON
*Attesting Officer*

C. MARSHALL DANN
*Commissioner of Patents and Trademarks*